US006840149B2

(12) United States Patent
Beal

(10) Patent No.: US 6,840,149 B2
(45) Date of Patent: Jan. 11, 2005

(54) IN-SITU FORMATION OF CAP FOR AMMUNITION PROJECTILE

(75) Inventor: Harold F. Beal, Rockford, TN (US)

(73) Assignee: Doris Nebel Beal inter vivos Patent Trust, Pawley's Island, SC (US)

( * ) Notice: Subject to any disclaimer, the term of this patent is extended or adjusted under 35 U.S.C. 154(b) by 45 days.

(21) Appl. No.: 10/145,927

(22) Filed: May 15, 2002

(65) Prior Publication Data

US 2002/0184995 A1 Dec. 12, 2002

Related U.S. Application Data

(60) Provisional application No. 60/281,397, filed on May 15, 2001.

(51) Int. Cl.[7] ..... F42B 33/00
(52) U.S. Cl. ..... 86/55; 102/516; 102/517
(58) Field of Search ..... 86/55; 102/501–529

(56) References Cited

U.S. PATENT DOCUMENTS 2,867,554 A * 1/1959 Wilson et al. ..... 148/540
4,498,395 A * 2/1985 Kock et al. ..... 102/517
4,665,828 A * 5/1987 Auer ..... 102/519
4,949,645 A * 8/1990 Hayward et al. ..... 102/517
5,078,054 A * 1/1992 Ashok et al. ..... 102/517
5,189,252 A * 2/1993 Huffman et al. ..... 102/459
5,394,597 A * 3/1995 White ..... 86/55
5,399,187 A * 3/1995 Mravic et al. ..... 75/228
5,440,995 A * 8/1995 Levitt ..... 102/517
5,527,376 A * 6/1996 Amick et al. ..... 75/246
5,540,749 A * 7/1996 Li et al. ..... 75/340
5,665,808 A * 9/1997 Bilsbury et al. ..... 524/439
5,760,331 A * 6/1998 Lowden et al. ..... 102/506
5,763,819 A * 6/1998 Huffman ..... 102/510
5,789,698 A 8/1998 Beal
5,847,313 A * 12/1998 Beal ..... 102/516
5,894,644 A * 4/1999 Mravic ..... 86/54
5,963,776 A * 10/1999 Lowden et al. ..... 419/64
6,074,454 A * 6/2000 Abrams et al. ..... 75/247
6,090,178 A * 7/2000 Benini ..... 75/245
6,317,946 B1 * 11/2001 Beal ..... 102/516
6,371,029 B1 4/2002 Beal
6,447,715 B1 * 9/2002 Amick ..... 420/430
6,536,352 B1 * 3/2003 Nadkarni et al. ..... 102/506
6,613,165 B1 * 9/2003 Alexander ..... 148/536
2002/0152915 A1 * 10/2002 Vaughn et al. ..... 102/507
2002/0178963 A1 * 12/2002 Halverson ..... 102/516
2002/0178964 A1 * 12/2002 Beal ..... 102/516
2003/0101891 A1 * 6/2003 Amick ..... 102/514

FOREIGN PATENT DOCUMENTS

DE 3226648 A1 * 1/1984

* cited by examiner

*Primary Examiner*—Jack Kam
*Assistant Examiner*—Troy Chambers
(74) *Attorney, Agent, or Firm*—Pitts & Brittian, PC

(57) ABSTRACT

A method of forming a gun ammunition projectile 52 including a leading end defined by an ogive 53 including the steps of admixing a quantity of a first powdered metal having a first melting point and a first density, with a quantity of a second powdered metal having a second, and lower, melting point and a second, and lesser, density, pressing a quantity of the admixed metal powders into a self-supporting compact having at least an outboard end disposing the compact in a cup-shaped jacket, heating the compact in the jacket, in a vertical attitude, to a temperature of at least the melting point of the second metal but less than the melting point of the first metal, for a time sufficient to result in a liquefied portion of the second metal migrating to and accumulating at the one outboard end of the compact.

21 Claims, 3 Drawing Sheets

IN-SITU FORMATION OF CAP FOR AMMUNITION PROJECTILE

CROSS REFERENCE TO RELATED APPLICATIONS

This application is a non-provisional application based on pending Provisional Application S. No. 60/291,397, filed May 15, 2001, entitled: METHOD FOR THE FORMATION OF A SOLID METAL CAP EMPLOYING HEATING OF A CORE IN A JACKET AND PRODUCT.

FIELD OF INVENTION

This invention relates to gun ammunition, and specifically to gun ammunition in which a round of the ammunition includes a casing which houses gunpowder and a projectile. More specifically, the present invention relates to projectiles for gun ammunition.

BACKGROUND OF INVENTION

Of relatively recent vintage is a gun ammunition projectile which is fabricated from two or more metal powders. Commonly, the metal powders are die-pressed into a cylindrical geometry. Such pressed compacts are at times referred to as "cores". In a common embodiment, to form a projectile, a core is placed in a hollow cup-shaped metal jacket having one end thereof closed and its opposite end open for the receipt of the core. After the core has been placed in the jacket, it is commonly seated against the closed end of jacket. Thereafter, the open end of the jacket, and that end of the core adjacent the open end of the jacket, are die-formed into an ogive. The formation of the ogive tends to partially crush that portion of the core which is involved in the formation of the ogive, generating unbonded and "semi-bonded" metal powder adjacent the leading end of the projectile. In those projectiles where the ogive end of the projectile is not fully closed, this unbonded or semi-bonded powder is free to escape from the jacket, or to move about within the ogive end of the jacket, during handling of a round of ammunition, while the round is in a gun, and/or after the round has been fired and the projectile is traveling to a target.

In U.S. Pat. No. 5,789,698, the present inventor disclosed the use of a solid metal disc disposed within the jacket adjacent the exposed end of the core prior to formation of the ogive. As the ogive is formed, this disc is also deformed and urged toward the open end of the jacket where it defines a cap which seals the open end of the jacket to prevent the escape of metal powder from the ogive end of the projectile and/or to preclude migration of loose powder non-uniformly radially of the longitudinal axis (the spin axis) of the projectile.

In each of the caps of the prior art, the cap has been formed externally of the projectile and thereafter introduced into a metal jacket with a core where the jacket-core-cap subassembly is die formed to define an ogive at the open end of the jacket.

It is an object of the present invention to provide a method for the in-situ formation a cap for use in gun ammunition, particularly ammunition for guns of 50 caliber or smaller calibers, such as the military 5.56 mm round, among others.

SUMMARY OF THE INVENTION

In accordance with one aspect of the method of the present invention, a self-supporting metal powder-based core comprising at least a first powder of a metal having a first melting point and a first density, and a second powder of a metal having a melting point that is lower than the melting point of the first powder and a density which is less than the density of the first metal, e.g. tungsten and tin metal powders. This core is disposed within a metal jacket having a closed (inboard) end and an open (outboard) end, followed by seating of the core within the closed end of the jacket. Thereafter, the jacket-core subassembly, in a substantially vertical attitude, is heated to at least the melting point of that one of the metal powders of the core which has the lower melting point. This heat treatment has been found by the present inventor to cause a substantial portion of the lower melting point metal powder to liquefy and migrate to the uppermost surface of the core where it accumulates in the form of a substantially semi-spherical projection on the outboard end of the core. This projection is substantially centered radially within the jacket. Upon cooling of the heated jacket-core subassembly, the lower melting point powder accumulated on the outer surface of the outboard end of the core solidifies. Thereupon, the jacket-core subassembly, including the substantially semi-spherical solidified projection, is loaded into a die and pressed axially of the jacket longitudinal centerline to flatten and spread the projection into a generally flat disc which substantially covers the outboard end of the core. This disc is of substantially uniform cross-section and exhibits substantially uniform distribution of density throughout the disc.

Thereafter, an ogive is die-formed on the outboard end of the jacket-core-disc combination. In the course of forming the ogive, the disc is deformed into a generally cup-shaped (generally hollow hemispherical) geometry, i.e. a cap, within the outboard end of the jacket. This cap may be caused to fully fill the outboard end of the jacket or it may be caused to fill less than all of the outboard end of the jacket, leaving a meplat cavity adjacent the open end of the jacket. In any event, the cap seals the open end of the jacket, and serves to retain any unbonded or semi-bonded powder particles against their movement within the jacket and to prevent the escape of such particles from the jacket.

DETAILED DESCRIPTION OF INVENTION

Figure 1:
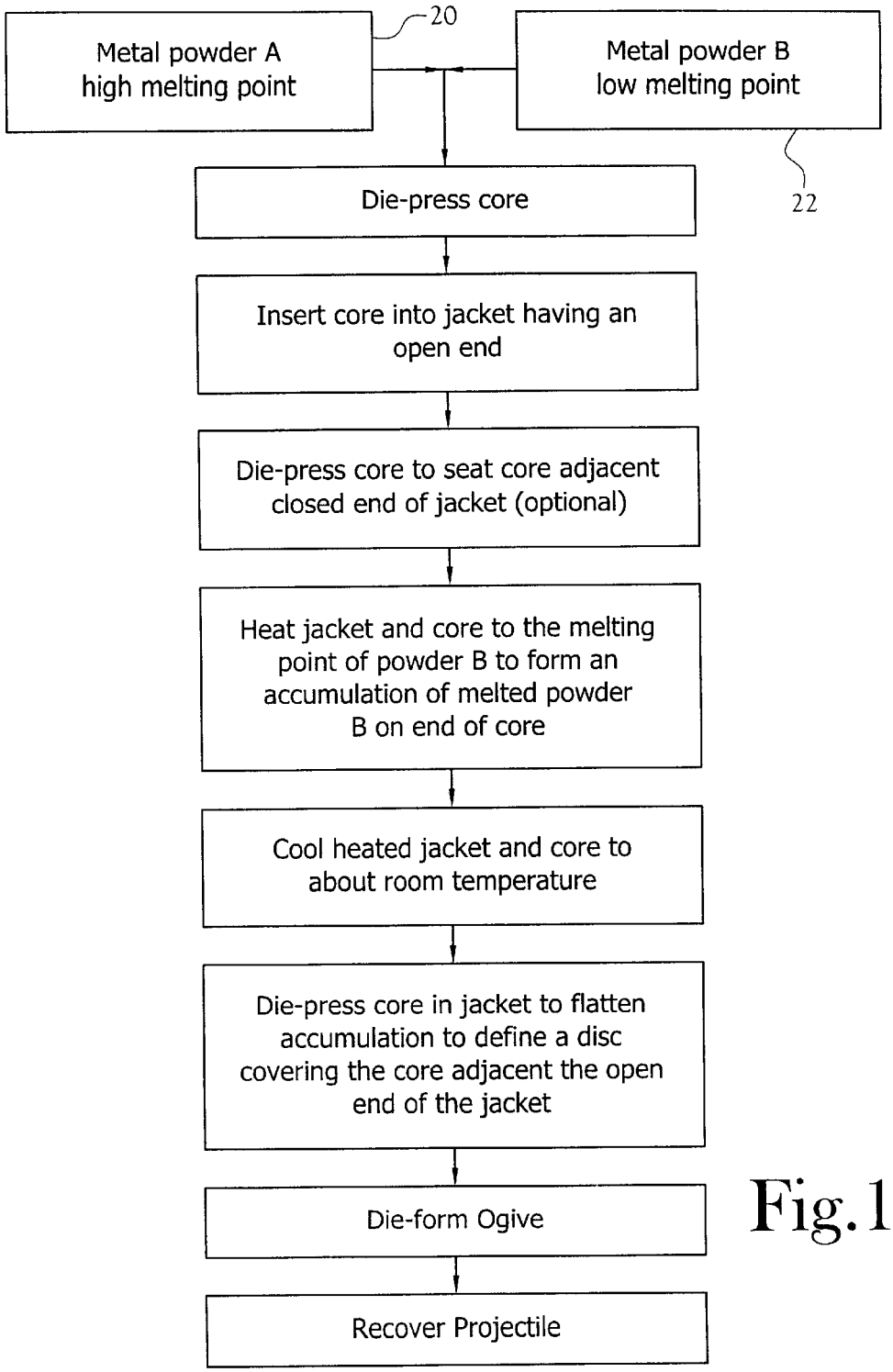
FIG. 1 is a schematic flow diagram of one embodiment of a method of the present invention.
Figure 2:
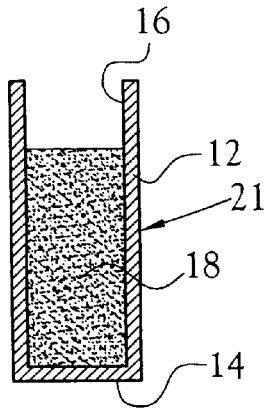
FIG. 2 is a representation, in section, of a subassembly including a metal jacket having an open end and a metal powder-based core disposed therein.
Figure 3:
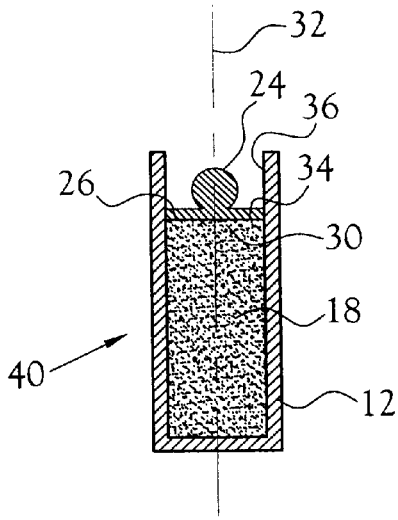
FIG. 3 is a representation, in section, of the metal jacket and core subassembly of FIG. 2 after heating thereof to a temperature approximately equal to the melting point of that metal powder of the core having the lower melting point, and depicting the formation of a solid metal generally hemispherical projection on the outboard end of the core.
Figure 4:
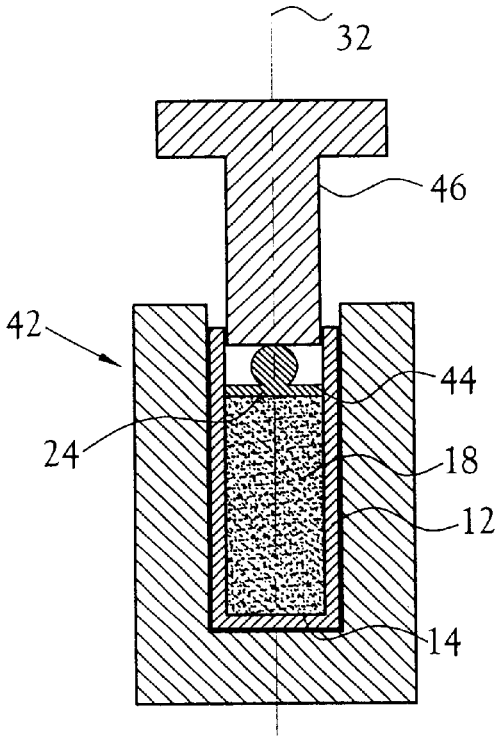
FIG. 4 is a representation, in section, of a die for applying axial pressure to the jacket and core subassembly of FIG. 3 to flatten and spread the projection.

Referring initially to FIGS. 1 and 2, to form a projectile in accordance with one embodiment of the present invention, a metal, e.g. copper, jacket 12 having a closed (inboard) end 14 and an open (outboard) end 16 is provided with a core 18 which is seated against the inboard end of the jacket. The core of the present invention is formed from a mixture of at least two metal powders, such as tungsten metal powder 20 and tin metal powder 22 which has been die-pressed into a self-supporting cylinder. It will be noted that the melting point of the tungsten powder is materially higher than the melting point of the tin powder and that both the tungsten powder and the tin powder are substantially uniformly mixed and dispersed throughout the core. A typical core so produced will include a very minor portion of air-pockets defined between areas of non-contact of the tungsten and tin powder particles of the core. Typical bulk densities of the a core may range considerably, but generally will be at least about 85% of the theoretical density of the combined tungsten and tin powders.

Referring to FIG. 2, upon heating of the jacket-core subassembly 21 in an oven 23 to a temperature at least as high as the melting point of that one of the metals having the lower melting point of the metals which comprise the core, such lower melting point metal has been found to form a substantial accumulation of the lower melting point metal, generally in the form of a substantially semi-spherical projection 24 on the outboard face 26 of the outboard end 30 of the core 18 within the jacket. This projection is substantially centered with respect to the longitudinal centerline 32 of the jacket, i.e., its outer circumference 34 at the outboard face 26 of the core is substantially concentric with the inner circumference 36 of the jacket. This projection, when cooled, is a solid metal, e.g. solid tin when the core is formed from tungsten and tin metal powders. Moreover, the projection is integrally formed with the face of the core and therefore immovable for purposes of further handling of the jacket-core-projection subassembly 40 in the course of further manufacturing operations. Further portions of the lower melting point metal powder also migrate to the outboard face of the core, and, when solidified, aid in the retention of the powder particles of the higher melting point metal powder as a part of the core.

Figure 5:
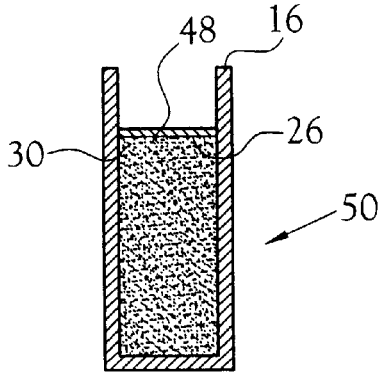
FIG. 5 depicts the die-pressing of an ogive on the outboard end of the jacket and core subassembly.
Figure 6:
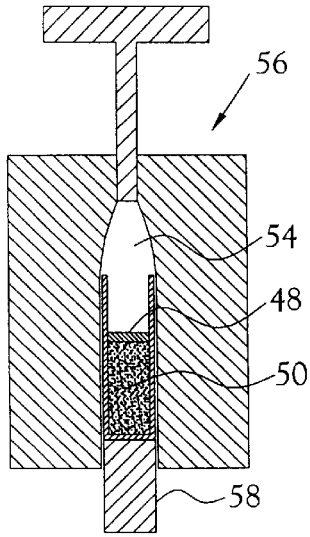
FIG. 6 depicts a completed projectile manufactured in accordance with the method of the present invention.
Figure 9:
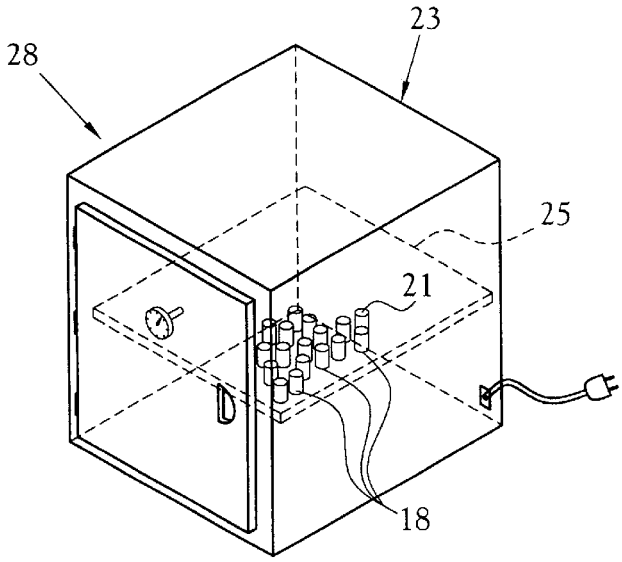
FIG. 9 depicts the heating of a plurality of cores (or jacket/core subassemblies) in an oven.

The jacket-core-projection subassembly 40 is thereafter placed in a die 42 having a cylindrical cavity 44. Employing a cylindrical punch 46 which is aligned axially with the longitudinal centerline 32 of the jacket, hence centered with respect to the projection 24, pressure is applied axially to the projection and core, the pressure being sufficient to flatten the projection and spread it radially outwardly to the inner circumference of the jacket. This action defines a substantially flat disc 48 (see FIG. 5) of solid metal, tin metal for example, which fully covers the outboard face of the outboard end of the core remains integral with the core and securely captures the core within the jacket. This subassembly 50 of jacket-core-disc is therefore suitable for handling during further manufacturing operations.

Figure 7:
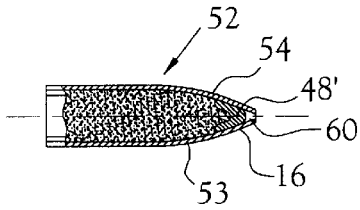
FIG. 7 depicts a round of ammunition which includes a projectile embodying various of the features of the present invention.

Completion of the projectile 52 (see FIG. 7) by the formation of an ogive 53 on the outboard end 16 thereof is achieved by placing the jacket-core-disc subassembly 50 into the cavity 54 of a die 56 and through the application of axial pressure against the closed end of the jacket, via a punch 58, the outboard ends of the jacket and core, along with the disc, are deformed to define the desired ogive. A completed projectile is depicted in FIG. 7 wherein it is noted that the disc 48 has been deformed into a generally cup-shaped cap 48' and the outboard end of the core has been deformed to at least partially fill the ogive and the hollow of the cup-shaped cap. The deformation of the disc into the cap effectively seals the open end of the jacket to block any escape of powder particles from the jacket during subsequently handling and/or firing of the projectile to a target. As desired, the cap may fully fill the open end of the jacket, or as in the embodiment depicted in FIG. 7, the cap may terminate short of the open end of the jacket, thereby defining a meplat cavity 60 adjacent the open end of the jacket. Moreover, the wedging of the cap within the interior of the ogive as the outboard end of the core is deformed into the ogive functions to capture and stabilize any unbonded or semi-bonded powder particles in fixed relationship to the longitudinal centerline of the jacket, hence to the spin axis of the resulting projectile.

Figure 8:
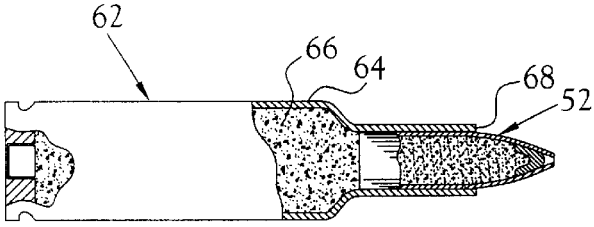
FIG. 8 is a schematic representation of a completed round of ammunition which includes a projectile embodying a core in accordance with the present invention.

Manufacture of a round of ammunition 62 (FIG. 8) employing the projectile 52 of the present invention includes the well known steps of at least partly filling a case 64 with gun powder 66 and thereafter inserting the projectile 52 into the open end 68 of the case, as depicted in FIG. 8.

In one example of the formation of a projectile in accordance with the method of the present invention, a core was formed by die-pressing a mixture of about 60% by wt. of tungsten metal powder with about 40% by wt. of tin powder at room temperature into a self-supporting cylinder. This core was loaded into a copper metal jacket having a closed end and an open end and pressed into seating relationship with the closed end of the jacket. This jacket-core subassembly was placed in an oven with the jacket-core subassembly oriented in an upright attitude with the closed end 14 of the jacket resting on and supported by a rack 25 in the oven. This subassembly was heated in the oven to a temperature of at least the melting point of the tin powder, i.e., 232° C. (as compared to the melting point for tungsten of 3410° C.). In the course of heating of the core, at least a portion of the tin powder liquefies and accumulates on the outboard face of the core to define a substantially semi-spherical projection on the outboard face of the core. The time required to reach the melting point of the tin powder varies with the proportion of tin within the core, and on the operating parameters of the oven employed, but in the present example, about ten minutes was consumed in bringing the core to the melting point of the tin powder. Thereupon, the door of the oven was opened to room temperature, thereby cooling the core to solidify the tin within the core and to solidify the projection formed on the face of the core.

The cooled jacket-core-projection subassembly was inserted into a cylindrical cavity in a die and axially pressed with a pressure sufficient to flatten (longitudinally) and spread the projection radially within the jacket to the extent that there was formed a disc of substantially uniform thickness covering substantially all of the outboard face of the core within the jacket. The disc also exhibited substantially uniform distribution of its density throughout the cap. The disc further was integrally formed with the outboard face of the core.

Thereafter, the jacket-core-disc subassembly was die-pressed to define an ogive at the open end of the jacket, including the deformation of the disc into a cap sealing the open end of the jacket, the die-pressed projectile being recovered and incorporated into a round of ammunition.

In an alternative embodiment, the combination of a jacket and a cooled core disposed therein was die-formed to define an ogive on the open end of the jacket, without passing through the step of flattening the solidified accumulation of the first metal powder in a die to a disc geometry prior to the forming of an ogive. Whereas the omission of the flattening step may be suitable for the formation of certain grades of gun ammunition, it is preferred that the flattening step be included in any manufacturing operation where maximum accuracy of delivery of the projectile to a target (especially at longer ranges of 600 yards or greater) is deemed critical.

Firings of multiple ones of the projectiles provided in accordance with the present invention were carried out employing standard military rifles. The accuracy of delivery of the projectiles to a target were consistently within acceptable values. For example, multiple projectiles of .223 caliber (5.56 mm) of seven ogive, all prepared in like manner, were fired from the same conventional law enforcement and military weapon namely a M16M4 military rifle having a seven twist barrel. Firings were from weapons having barrel lengths of 10 inches, 14.5 inches and 20 inches. All the projectiles exhibited excellent spin stability and accuracies of about on minute of angle at 600 yards.

The tin powder employed in the present example was about 325 mesh or smaller in particle size. This powder, in a substantially non-oxidized state, when uniformly mixed with tungsten metal powder, also of about 325 mesh particle size and pressed in a die at room temperature, at about 16,000 psi to about 18,000 psi is formed into a self-supporting compact. Other metal powders, such as zinc, iron, aluminum, copper, magnesium, bismuth or mixtures of these or similar relatively light-weight metal powders, including alloys thereof, may be employed in the manufacture of the core of the present invention.

Whereas the present invention has been described herein at times employing specific materials, operational methods and/or parameters, it will be recognized by one skilled in the art that suitable variations may be employed without departing from the scope of the invention as defined in the claims appended hereto.

What is claimed:

1. A method of forming a gun ammunition projectile including a leading end defined by an ogive including the steps of admixing a quantity of a first powdered metal having a first melting point and a first density with a quantity of a second powdered metal having a second, and lower, melting point and a second, and lesser, density than said first metal, pressing a quantity of said admixed powdered metals into a self-supporting compact having at least an outboard end, introducing said compact into a cup-shaped jacket, having an open end, with said outboard end of said compact disposed internally of and adjacent said open end of said jacket, heating said compact in said jacket to a temperature of at least the melting point of said second metal but less than the melting point of said first metal, for a time sufficient to result in a liquefied portion of said second metal migrating to and accumulating at said one outboard end of said compact, said accumulated second metal being disposed within said jacket.

2. The method of claim 1 and including the step of cooling said heated compact in said jacket to solidify said accumulated portion of said second metal.

3. The method of claim 2 and including the step of die-forming said solidified accumulated portion of said second metal within said jacket into a substantially flat disc geometry integral with said at least outboard end of said compact.

4. The method of claim 2 and including the step of die-forming said accumulation of said second metal in said jacket, at least a portion of said compact, and the leading end of the said jacket into an ogive geometry.

5. The method of claim 4 and including the step of die-pressing said accumulation of said second metal into a substantially flat disc prior to die-forming said ogive.

6. The method of claim 1 wherein said first metal is tungsten.

7. The method of claim 1 wherein said second metal is tin, lead, iron, aluminum, magnesium, bismuth or mixtures or alloys thereof.

8. The method of claim 7 wherein said first and second powdered metals each exhibits an average particle size of about 325 mesh or smaller.

9. The method of forming a gun ammunition projectile including a leading end defined by an ogive including the steps of admixing a quantity of a first powdered metal having a first melting point and a first density with a quantity of a second powdered metal having a second, and lower, melting point and a second, and lesser, density than said first metal, pressing a quantity of said admixed metal powders into a self-supporting compact of a substantially elongated geometry having a longitudinal centerline and at least an outboard end, introducing said compact into a cup-shaped jacket having an open end, with said outboard end of said compact disposed internally of and adjacent said open end of said jacket, while said compact within said jacket is oriented with said longitudinal centerline of said compact disposed essentially vertical and said outboard end thereof disposed most vertical of the compact, heating said compact in said jacket to a temperature of at least the melting point of said second metal powder but less than the melting point of said first metal powder, for a time sufficient to result in a liquefied portion of said second metal powder migrating to and accumulating at said one outboard end of said compact.

10. A projectile manufactured in accordance with the method of claim 9.

11. A round of gun ammunition comprising a projectile produced in accordance with the method of claim 10.

12. A method of forming a gun ammunition projectile including a leading end defined by an ogive including the steps of admixing a quantity of powdered tungsten with a quantity of either powdered tin, zinc, iron, aluminum, magnesium, bismuth or mixtures or alloys thereof, pressing a quantity of said admixed powdered metals into a self-supporting compact having at least an outboard end, introducing said compact into a cup-shaped metal jacket, having an open end, with said outboard end of said compact disposed internally of and adjacent said open end of said jacket, heating said compact in said jacket to a temperature of at least the melting point of said second metal but less than the melting point of said tungsten, for a time sufficient to result in a liquefied portion of said second metal migrating to and accumulating at said one outboard end of said compact, said accumulated second metal being disposed within said jacket.

13. The method of claim 12 wherein said second metal is tin.

14. The method of claim 12 wherein each of said tungsten and second metal powders exhibits a particle size of about 325 mesh.

15. The method of claim 12 wherein said tungsten and said second metal are present in the admixture in a ratio of about 60% tungsten, by weight, and about 40%, by weight, of said second metal.

16. The method of claim 12 and including the step of, after cooling, die-pressing said cooled compact in said jacket in an axial direction to deform said projection of second metal sufficiently to cause said second metal to define a substantially disc geometry which substantially closes said open end of said jacket.

17. The method of claim 16 and including the step of forming an ogive on the open end of said jacket, said ogive including said disc and at least a portion of said outboard end of said compact.

18. In a method for the formation of a powder-based projectile for gun ammunition from a cup-shaped metal jacket having an open end and a core having an outboard end and being defined by a self-supporting compact of multiple metal powders, at least one of which is tungsten and at least one of which is a metal having a density and melting points less than the density and melting points of tungsten disposed within the jacket, the improvement comprising heating said jacket/core combination to a temperature of at least the melting point of said metal of lower density and lower melting point whereby said metal of lower density and lower melting point liquefies and at least a portion thereof migrates to and accumulates at the outboard end of said core.

19. The improvement of claim 18 wherein said second metal is tin, zinc, iron, copper, aluminum, magnesium, bismuth or mixtures or alloys thereof.

20. The improvement of claim 18 wherein each of said tungsten and second metal powders exhibits a particle size of about 325 mesh.

21. The improvement of claim 18 wherein said tungsten and said second metal are present in the admixture in a ratio of about 60% tungsten, by weight, and about 40%, by weight, of said second metal.

* * * * *